United States Patent [19]

Gilkey et al.

[11] 4,056,356

[45] Nov. 1, 1977

[54] POLYESTER FIBER

[75] Inventors: Russell Gilkey, Kingsport; Samuel D. Hilbert, Jonesboro; Bobby J. Sublett; Thomas H. Wicker, Jr., both of Kingsport, all of Tenn.

[73] Assignee: Eastman Kodak Company, Rochester, N.Y.

[21] Appl. No.: 664,841

[22] Filed: Mar. 8, 1976

Related U.S. Application Data

[63] Continuation-in-part of Ser. No. 577,361, May 14, 1975, abandoned, which is a continuation-in-part of Ser. No. 468,309, May 9, 1974, abandoned, which is a continuation-in-part of Ser. No. 468,310, May 9, 1974, abandoned, which is a continuation-in-part of Ser. No. 468,311, May 9, 1974, abandoned, which is a continuation-in-part of Ser. No. 468,312, May 9, 1974, abandoned.

[51] Int. Cl.[2] ..... D01F 6/62; D01F 9/08

[52] U.S. Cl. ..... 8/168 C; 8/DIG. 4; 8/162 R; 8/166; 260/45.7 P; 260/75 P

[58] Field of Search ..... 8/168 C, DIG. 4, 162 R, 8/166; 260/45.7 P, 45.95, 75 P

[56] References Cited

U.S. PATENT DOCUMENTS

| | | | |
|---|---|---|---|
| 3,412,070 | 11/1968 | Jakob et al. | 260/75 P |
| 3,445,504 | 5/1969 | Mehalso | 260/75 P |
| 3,446,763 | 5/1969 | Okuzumi | 260/75 P |
| 3,488,298 | 1/1970 | Barkey et al. | 260/77 |
| 3,651,017 | 3/1972 | Tanabe et al. | 260/75 P |
| 3,669,925 | 6/1972 | King et al. | 260/45.95 |
| 3,692,867 | 9/1972 | Mayer et al. | 260/45.7 P |
| 3,773,715 | 11/1973 | Largman et al. | 260/45.7 P |
| 3,784,507 | 1/1974 | Braunstein | 260/45.7 P |

*Primary Examiner*—John Kight, III

*Attorney, Agent, or Firm*—Charles R. Martin; Daniel B. Reece, III

[57] ABSTRACT

Disclosed is a textile fiber comprised of a poly(oxyethylene)-glycol modified poly(1,4-cyclohexylenedimethylene terephthalate) type polyester containing phosphorus, a stabilizer, an organic titanium compound, and optionally a manganous ion. The fiber exhibits an unobvious combination of commercially acceptable mechanical properties, commercially acceptable lightfastness, commercially acceptable gasfastness, and commercially acceptable dye rate.

3 Claims, No Drawings

POLYESTER FIBER

This application is a continuation-in-part of our copending application Ser. No. 577,361 filed May 14, 1975, entitled "Polyester Fiber", now abandoned which is a continuation-in-part of Ser. No. 468,309 filed May 9, 1974, entitled "Deep Dyeable Polyester Fiber", now abandoned; Ser. No. 468,310 filed May 9, 1974, entitled "Deep Dyeable Polyester Fiber", now abandoned; and Ser. No. 468,312 filed May 9, 1974, entitled "Deep Dyeable Polyester Fiber", Ser. No. 468,311 filed May 9, 1974, entitled "Deep Dyeable Polyester Fiber", now abandoned.

This invention relates to a carpet fiber dyeable without a carrier that exhibits an unobvious combination of commercially acceptable mechanical properties, commercially acceptable lightfastness, commercially acceptable gasfastness, and commercially acceptable dye rate.

Multicolored carpets have gained wide acceptance in recent year because of their aesthetic qualities. Because of economic considerations, the multicolor character of the carpet must be achieved by contacting the greige carpet with a plurality of dyes in one dyeing operation. Thus, if one desires to prepare a carpet of three colors, then three different types of synthetic carpet fibers can be used to prepare a greige carpet and the griege carpet is dyed to three different colors in one dyeing operation.

Polyester fibers have gained wide acceptance for preparation of three color carpets. When preparing a three color carpet of polyester fibers, typically the carpet is formed from a first fiber that dyes to a light shade of a first color, a second fiber that dyes to a deep shade of the first color and a third fiber that dyes to a second color complementary to the first color. A dyebath containing a disperse dye, such as an orange dye, and a basic dye, such as a brown dye, is prepared. When the garage carpet is dyed in this dyebath a three color carpet results. The first fiber takes up a smaller amount of the orange disperse dye and dyes to a light orange shade. The second fiber takes up a larger amount of the orange disperse dye and dyes to a deep orange shade. The third fiber takes up the brown basic dye as well as the orange disperse dye and dyes to a brown since the brown complements and masks the orange.

Deep dyeable and light dyeable polyester fibers that are dyeable without a carrier and a useful in preparing three color carpets can be commercially unacceptable for a variety of reasons.

One reason deep dyeable and light dyeable polyester fibers that are dyeable without a carrier can be unacceptable for commercial use is that the fibers can exhibit an overall balance of mechanical properties that is unacceptable. For instance, if the mechanical properties such as tenacity, elongation, work recovery and length recovery are unacceptable the fiber is commercially unacceptable.

Another reason deep dyeable and light dyeable polyester fibers that are dyeable without a carrier can be unacceptable for commercial use is that the dye lightfastness of the fibers is commercially unacceptable. Since the aesthetic qualities of a three color carpet are derived in part from the selection of three colors that complement each other, the entire carpet can become asthetically unattractive if any one of the fibers fade because the faded character of the one fiber can destroy the complementary character of the combination of colors.

Still another reason deep dyeable and light dyeable polyester fibers that are dyeable without a carrier can be unacceptable for commercial use is that the gasfastness of the fibers is commercially unacceptable. As in the case of lightfastness, since the aesthetic qualities of a three color carpet are derived in part from the selection of three colors that complement each other, the entire carpet can become aesthetically unattractive if any one of the fibers fade because the faded character of the one fiber can destroy the complementary character of the combination of colors.

Still another reason deep dyeable and light dyeable polyester fibers that are dyeable without a carrier can be commercially unacceptable is a dye rate that is too low. In order for a fiber to be economically acceptable, the dye rate of the fiber should be above a minimum acceptable level. This is especially true of continuous dyeing on a Kuesters Range. If the steaming time required to get satisfactory penetration of the dye is too long, the cost involved in dyeing the fiber will become so high the fiber becomes noncompetitively priced.

We have now invented a polyester fiber that is dyeable without a carrier and overcomes the above noted reasons that a fiber of this type can be commercially unacceptable.

Polyester fibers containing manganous ion are disclosed in U.S. Pat. No. 3,668,188. Polyester fibers containing manganous ion and a stabilizer are disclosed in U.S. Pat. No. 3,669,925.

Other prior art applicants are aware of is U.S. Pat. Nos. 3,412,070, 3,445,504, 3,446,763, 3,488,298, 3,651,017, 3,692,867, 3,773,715 and 3,784,507.

The fiber of this invention is believed to be unobvious over the prior art because the fiber exhibits an obvious combination of a commercially acceptable overall balance of mechanical properties, commercially acceptable lightfastness, commercially acceptable gasfastness, and a commercially acceptable dye rate.

By the term "a commercially acceptable overall balance of mechanical properties", and words of similar import, we mean that the typical synthetic fiber properties such as tenacity, elongation, work recovery, length recovery, modulus, processing characteristics, including carding and spinning into a yarn, carpet performance, etc., at least meet current industry standards for commercial acceptability.

By the term "commercially acceptable lightfastness," and works of similar import, we mean that the lightfastness of the fiber at least corresponds to generally accepted standards in the carpet industry for lightfastness. In one aspect, a dyed fabric of the fiber exhibits no fading after 20 standard hours in a carbon arc or Xenon Fade-Ometer and in another embodiment the fiber exhibits a very slight break after 40 standard hours in a carbon arc or Xenon Fade-Ometer.

By the term "commercially acceptable gasfastness," and words of similar import, we mean that the gasfastness of the fiber at least corresponds to generally accepted standards in the carpet industry for gasfastness. In one aspect, a dyed fabric of the fiber exhibits no appreciable fading after 1 cycle in test method AATCC 23-1962 and in another embodiment the fabric exhibits a slight break after 3 cycles in this test.

By the term "commercially acceptable dye rate," and words of similar import, we mean that the fiber dyes at a rate that is sufficiently rapid to meet the dyeability requirements consistent with the time limitations required for dyeing in a typical commercial dyeing operation.

The unobvious combination of a commercially acceptable overall balance of mechanical properties, commercially acceptable lightfastness, commercially acceptable gasfastness, and commercially acceptable dye rate of the textile fiber of this invention is thought to result from employing in the polyetherester a combination of a critical range of stabilizer, a critical moleular weight range of poly(oxyethylene)glycol, and a critical range of titanium derived from an organic titanium catalyst.

The range of stabilizer that is a critical feature of applicants' invention is 1000 to 5000 weight parts per million, based on the weight of the polyetherester. If less than 1000 parts per million stabilizer are used, the fibers have commercially unacceptable mechanical properties, such as retention of tensile properties on exposure to air and heat, and commercially unacceptable dye lightfastness after being fully processed into yarn. If more than 5000 weight parts per million stabilizer are used, the fiber have commercially unacceptable gasfastness, especially in the presence of high titanium concentrations.

The range of molecular weight of poly(oxyethylene)-glycol that is a critical feature of applicants' invention is from 300 to 800. If a poly(oxyethylene)glycol of less than 300 molecular weight is used, the fibers have a commercially unacceptable dye rate. If a poly(oxyethylene)-glycol of more than 800 molecular weight is used, the fibers have commercially unacceptable dye lightfastness.

The range of titanium that is a critical feature of applicants' invention is 25 to 200 weight parts per million, based on the weight of the polyetherester. If less than 25 weight parts per million titanium is used, the polyetherester cannot consistently be prepared in commercial manufacturing equipment to a molecular weight suitable for spinning into a commercially acceptable textile fiber. If more than 200 weight parts per million titanium is used the fibers tend to exhibit commercially unacceptable dye lightfastness and commercially unacceptable gasfastness.

In the broadest aspect of this invention the fiber can be described as a deep dyeable or light dyeable fiber comprised of A. a polyetherester of
   1. terephthalic acid, and
   2. a diol component comprised of
      a. 1,4-cyclohexanedimethanol, and
      b. from 3 to 12 weight percent, based on the weight of the polyetherester, of poly(oxyethylene)glycol having a molecular weight in the range of 300–800, B. based on the weight of the polyetherester, from 0–150 weight parts per million of manganous ion, C. based on the weight of the polyetherester, from 20–500 weight parts per million phosphorus derived from certain phosphorus compounds useful in this invention, D. based on the weight of the polyetherester, from 1000 to 5000 weight parts per million of a stabilizer effective to reduce oxidative degradation of the polyetherester, and E. based on the weight of the polyetherester, from 50–200 weights parts per million titanium derived from a soluble tetravalent organic titanium compound.

As will be recognized by those skilled in the art, the amount of poly(oxyethylene)glycol is related to the depth of shade that will be achieved when the fiber is dyed without a carrier disperse dye. Generally speaking, the more poly(oxyethylene)glycol that is used the darker will be the shade of the dyed fiber and the less poly(oxyethylene)glycol that is used the lighter will be the shade of the dyed fiber. Accordingly, in the broadest embodiment of this invention there is provided a deep dyeable or light dyeable fiber wherein the amount of poly(oxyethylene)glycol is from 3 to 12 weight percent. In one specific embodiment of this invention there is provided a light dyeable fiber wherein the amount of poly(oxyethylene)glycol is from 3 to 6 weight percent. In another specific embodiment of the invention there is provided a deep dyeable fiber wherein the amount of poly(oxyethylene)glycol is from 8 to 12 weight percent.

The light dyeable fiber of one specific embodiment of the invention can be described as a textile fiber compound of A. a polyetherester of
   1. terephthalic acid, and
   2. a diol component comprised of
      a. 1,4-cyclohexanedimethanol, and
      b. from 3 to 6 weight percent, based on the weight of the polyetherester, of poly(oxyethylene)-glycol having a molecular weight in the range of 400–600, B. based on the weight of the polyetherester, from 0–20 weights parts per million of manganous ion, C. based on the weight of the polyetherester, from 20–200 weight parts per million phosphorus derived from the same phosphorus compounds useful in the broader embodiment of the invention, D. based on the weight of the polyetherester, from 1000 to 3000 weight parts per million of a specific stabilizer, and E. based on the weight of the polyetherester, from 50–150 weight parts per million titanium derived from a compound corresponding to the structure

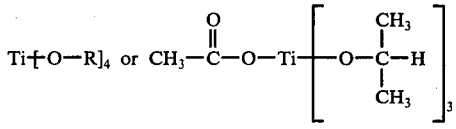

R is a monovalent alkyl radical having 3–8 carbon atoms.

The deep dyeable fiber of another specific embodiment of this invention can be described as a textile fiber comprised of A. a polyetherester of
   1. terephthalic acid, and
   2. a diol component comprised of
      a. 1,4-cyclohexanedimethanol, and
      b. from 8 to 12 weight percent, based on the weight of the polyetherester, of poly(oxyethylene)glycol having a molecular weight in the range of 400–600, B. based on the weight of the polyetherester, from 20–100 weight parts per million of manganous ion, C. based on the weight of the polyetherester, from 40–240 weight parts per million phosphorus derived from the same phosphorus compounds useful in the broader embodiment of the invention, D. based on the weight of the polyetherester, from 1500 to 3500 weight parts per million of a specific stabilizer, and E. based on the weight of the polyetherester, from 50–150 weight parts per million titanium derived from a compound corresponding to the structure

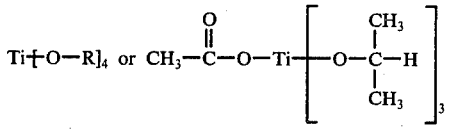

where

R is a monovalent alkyl radical having 3–8 carbon atoms.

In this invention the polyetherester is formed from terephthalic acid and a diol component comprised of 1,4-cyclohexanedimethanol and poly(oxyethylene)-glycol. In the the broadest embodiment of this invention where either a light dyeable or deep dyeable fiber can be prepared, the amount of poly(oxyethylene)glycol is from 3 to 12 weight percent based on the weight of the polyetherester. If less than 3 weight percent poly(oxyethylene)glycol is used the fiber will not exhibit acceptable dyeability without a carrier. If more than about 12 weight percent poly(oxyethylene)glycol is used the overall balance of properties of the fiber tend to become unacceptable. In the deep dyeable fiber embodiment of this invention the amount of poly(oxyethylene)glycol is from 8 to 12 weight percent based on the weight of the polyetherester. In the light dyeable fiber embodiment of the invention the amount of poly(oxyethylene)glycol is from 3 to 6 weight percent, based on the weight of the polyetherester. The molecular weight of the poly(oxyethylene)glycol is in the range of 300 to 800, preferably from 400 to 600, calculated as average molecular weight in accordance with procedures for molecular weight determination by end group analysis and ebulliometry.

As will be recognized by those skilled in the art, the moles of diol components must be substantially the same as the moles of terephthalic acid component in the final polyetherester or the molecular weight of the polyetherester will not be high enough to form the claimed textile fiber.

This invention has been described in terms of the acid forms of terephthalic acid but the term "terephthalic acid," and words of similar import, is intended to include esters of terephthalic acid such as the dimethyl, diethyl, and diphenyl esters. The dimethyl ester is preferred.

The manganous ion which can optionally be used in this invention is in the form of a salt such as formate, acetate, propionate, and benzoate. In the broader deep dyeable or light dyeable fiber embodiment of the invention, the amount of manganous ion ranges from 0–150 weight parts per million, based on the weight of the polyetherester. In the deep dyeable fiber embodiment of the invention, the amount of manganous ion is 20–100 weights parts per million, based on the weight of the polyetherester. In the light dyeable fiber embodiment of the invention, the amount of manganous ion is 0–20 weight parts per million, based on the weight of the polyetherester. If more than about 150 parts per million of manganous ion are used the fiber tends to exhibit poor oxidative stability.

The fiber of this invention contains phosphorus derived from the phosphorus compounds useful in this invention.

In one aspect of this invention, the phosphorus compound can be phosphorus acid, phosphoric acid, pyrophosphoric acid or polyphosphoric acid.

These compounds and methods for their preparation are well known in the art.

In another aspect of this invention, the phosphorus compound corresponds to the formula

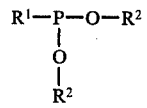

where $R^1$ is —H, a monovalent alkyl radical having 1–18 carbon atoms, a monovalent aryl or substituted aryl radical having 6–15 carbon atoms, or —O—R where R is the same as $R^1$, $R^2$ is —H, monovalent alkyl radical having 1–18 carbon atoms, or a monovalent aryl or substituted aryl radical having 6–15 carbon atoms, provided that when $R^2$ is alkyl, at least one of $R^2$ has a chain of at least two unsubstituted methylene groups attached to the oxygen atom attached to phosphorus.

Examples of monovalent alkyl radicals having 1 to 18 carbon atoms include methyl, ethyl, n-propyl, n-butyl, 2,2-dimethylbutyl, 2,2-dimethylhexyl, n-pentyl, n-hexyl, 2-ethylhexyl, n-octyl, 2,2-dimethyloctyl, n-nonyl, n-decyl, dodecyl, 2,2-dimethyldecyl, stearyl, and the like. In this disclosure the term "alkyl" also includes cyclic alkyl, sometimes called alicyclic.

Examples of monovalent aryl or substituted aryl radicals having 6 to 14 carbon atoms include

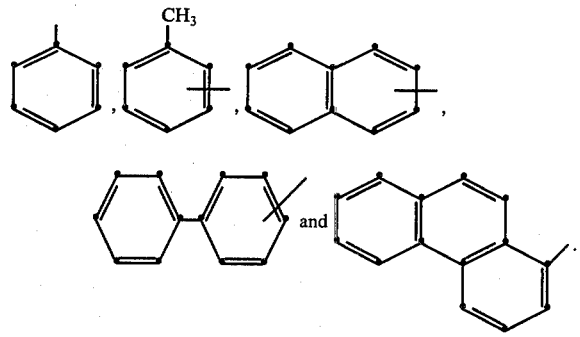

These compounds and methods for their preparation are well known in the art.

In a further aspect of this invention, the phosphorus compound corresponds to the formula

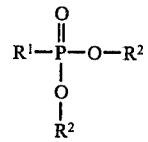

where $R^1$ and $R^2$ are the same as above.

These compounds and methods for their preparation are well known in the art.

In still a further aspect of this invention, the phosphorus compound can correspond to the formula

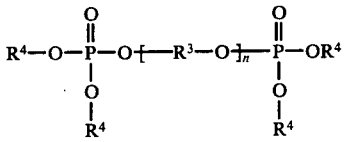

where $R^4$ is —H, a monovalent alkyl radical having 1–18 carbon atoms, or a monovalent aryl or substituted aryl radical having 6–15 carbon atoms, $n$ = 1–6, and $R^3 = -(CH_2)_x$ where $x$ = 2–6.

Examples of monovalent alkyl radicals having 1 to 18 carbon atoms include methyl, ethyl, n-propyl, n-butyl, isopropyl, n-pentyl, n-hexyl, 2-ethylhexyl, n-octyl, n-nonyl, n-decyl, dodecyl, stearyl, and the like.

Examples of monovalent aryl or substituted aryl radicals having 6 to 14 carbon atoms include

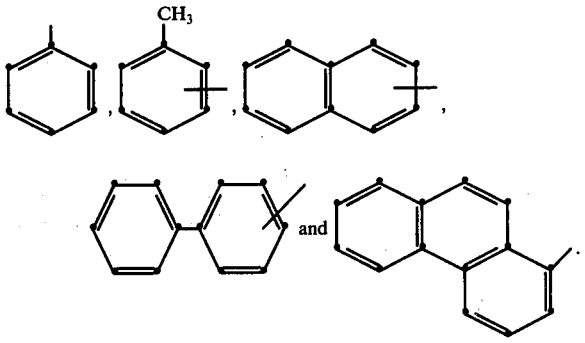

One preferred compound of this type occurs when $n$ is 1 to 3, $x$ is 2 and $R^4$ is a monovalent alkyl radical having 8 carbon atoms, with the proviso that one $R^4$ is always hydrogen. The compound corresponding to this preferred structure is commercially available from the E. I. duPont de Nemours Company and is sold under the trade name "Zonyl A."

In a still further aspect of this invention the phosphorus compound can correspond to the structure

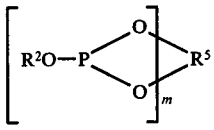

$R^2$ is the same as above, $R^5$ is a divalent or tetravalent alkyl radical having 2–5 carbon atoms, $m$ = 1 or 2.

Examples of divalent alkyl radicals having 2–5 carbon atoms include ethylene, 1,2-propylene, 2,2-dimethyltrimethylene, and the like. An example of a tetravalent alkyl radical having 5 carbon atoms is

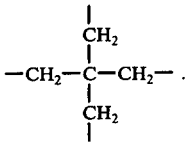

These compounds and methods for the preparation are well known in the art.

In a still further aspect of this invention, the phosphorus compound can correspond to the structure

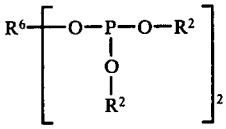

where $R^2$ is the same as above, $R^6$ is a divalent alkyl radical having 2–12 carbon atoms or a divalent aryl or substituted aryl radical having 6–15 carbon atoms.

Examples of divalent alkyl radicals having 2–12 carbon atoms include ethylene, propylene, 2,2-dimethyl trimethylene, decamethylene, and the like.

Examples of suitable divalent aryl or substituted aryl radicals having 6 to 15 carbon atoms include

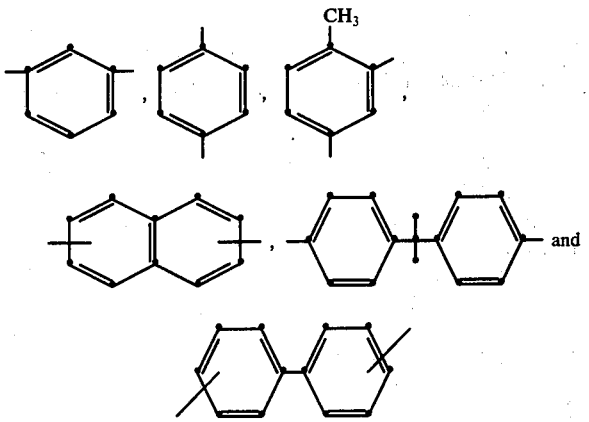

These types of compounds and methods for their preparation are well known in the art.

In a still further aspect of this invention the phosphorus compound can correspond to the structure

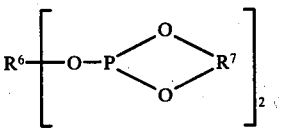

where $R^6$ is the same as above, and $R^7$ is a divalent alkyl radical having 2–5 carbon atoms.

Examples of divalent alkyl radicals having 2–5 carbon atoms are $-CH_2CH_2-$ , $-CH_2CH_2CH_2-$ , $-CH_2CH_2CH_2CH_2-$ , -continued

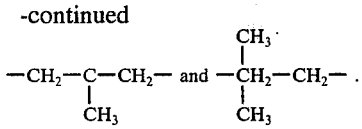

In this invention the phosphorus is disclosed as being "derived from" certain compounds. By the term "derived from," and words of similar import, we mean that the phosphorus compound chemically combines either partially or completely with other materials depending at what stage during the polymerization, spinning or fiber processing it is introduced into the polymer and consequently the phosphorus compound per se does not necessarily exist in the final polyetherester. Specifically, it is thought that a portion of the ester linkages of the phosphorous compound introduced in the polymer esterifies into the polymer chain and is present as monomeric or polymeric phosphite, phosphate or phosphonate esters of the diols or oligomers. In addition, it is thought that other linkages of the phosphorus compound introduced into the polymer chemically combine with metal ions which are present in the polyetherester from various sources, such as from polymerization catalysts, from the manganese ion or from trace impurities.

The phosphorus compounds useful in this invention have been described in terms of phosphorous compounds containing ester and/or —OH acid groups. As will be recognized by those skilled in the art, functionally equivalent amine or alkali metal salts can be used in place of the —OH acid group. Although this invention is described in terms of phosphorus compounds containing ester and/or —OH acid groups, it is to be understood that corresponding alkali metal salts and amine salts are within the scope of the invention provided that at least one ester group is present.

In the broader embodiment of this invention where the fiber is deep dyeable or light dyeable, the amount of phosphorus can range from 20–500 weight parts per million, based on the weight of the polyetherester. In the specific embodiment of the invention where the fiber is light dyeable the amount of phosphorus is 20–200 weight parts per million, based on the weight of the polyetherester. In the specific embodiment of the invention where the fiber is deep dyeable, the amount of phosphorus is 40–240 weight parts per million, based on the weight of the polyetherester.

In this invention a stabilizer is used to prevent oxidative degradation of the polyetherester. Broadly the stabilizer useful in our invention can be described as a relatively nonvolatile hindered phenolic antioxidant corresponding to the structure

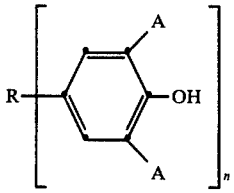

where $n$ is from 1 to 4,

R is a radical selected from the group consisting of 1. neopentanetetrayltetrakis[oxy(3-oxotrimethylene)],
2. phosphinylidynetrioxy,
3. 2,4,6-trimethyl-1,3,5-benzenetriyltrimethylene,
4. alkylene having 1 to 5 carbon atoms,
5. alkyl having 1 to 12 carbon atoms, and
6. 2,4,6-trioxo-1,2,3,4,5,6-hexahydro-s-triazine-1,3,5-triyl)tris(3-oxotrimethylene), and
7. [3-octadecyloxy)-3-oxopropyl].

A is a monovalent radical selected from the group consisting of 1. tertiary alkyl having 4 to 8 carbon atoms,
2. alkyl having 8 to 22 carbon atoms, and
3. secondary alkyl having 12 to 24 carbon atoms.

Examples of alkylene radicals having 1 to 5 carbon atoms include —$CH_2$—, —$CH_2CH_2$—,

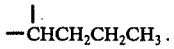

Examples of alkyl radicals having 1 to 12 carbon atoms include $CH_3$—, $C_2H_5$—, $C_3H_7$, $C_6H_{13}$—, $C_9H_{19}$—, and $C_{12}H_{25}$—.

Examples of monovalent tertiary alkyl radicals having 4 to 8 carbon atoms include —$C(CH_3)_3$, —$C(C_2H_5)(CH_3)_2$,

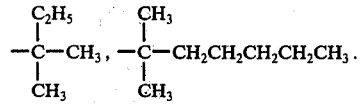

Examples of monovalent alkyl radicals having 8 to 22 carbon atoms include

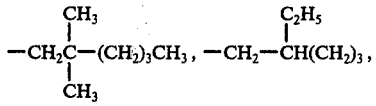

—$CH_2(CH_2)_6CH_3$, —$CH_2(CH_2)_{10}CH_3$, and —$C_{18}H_{37}$.

Examples of monovalent secondary alkyl radicals having 12 to 24 carbon atoms include

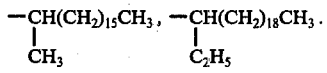

A preferred antioxidant is pentaerythritol tetrakis[3-(3,5-tert-butyl)-4-hydroxyphenyl]propionate which is sold commercially as Irganox 1010 by Geigy Chemical Company and corresponds to the structure

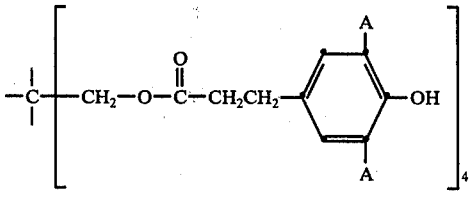

where

A is 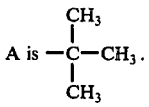 .

Among the other hindered phenols which are useful in our invention are 4,4'-butylidenebis(6-tert-butyl-m-cresol), 1,3,5-trimethyl-2,4,6-tris(3,5-di-tert-butyl-4-hydroxybenzyl)benzene, tris(3,5-di-tert-butyl)4-hydroxyphenyl phosphate, and dioctadecyl 3,5-di-tert-butyl-4-hydroxybenzyl phosphonate.

In the broader embodiment of this invention where the fiber is deep dyeable or light dyeable, 1000 to 5000 weight parts per million stabilizer, based on the weight of the polyetherester, can be used. In the specific embodiment of this invention where the fiber is deep dyeable, from 1500 to 3500 weight parts per million, based on the weight of the polyetherester, can be used. In the specific embodiment of this invention where the fiber is light dyeable, from 1000 to 3000 weight parts per million, based on the weight of the polyetherester, can be used.

The fiber of this invention contains titanium derived from a soluble tetravalent organic titanium compound that functions as a catalyst for preparation of the polyetherester. In a preferred embodiment the titanium compound corresponds to the structure

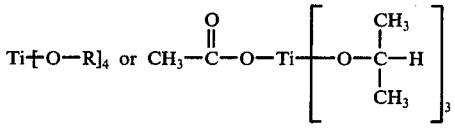

where R is a monovalent alkyl radical having 3–8 carbon atoms. Examples of suitable monovalent alkyl radicals are isopropyl, butyl, isobutyl, hexyl, heptyl and octyl. Preferably isopropyl is used.

The titanium compounds useful in this invention, and methods for their preparation, are well known in the art.

In this invention the titanium compound is disclosed to be "soluble." By this term we mean the titanium compound or its reaction products will dissolve in the materials used to prepare the polymer and will remain in solution as the polymer increases in molecular weight and remains in solution in the final polymer.

In this invention the titanium compound is disclosed to be "organic." By this term we mean the titanium compound is composed of groups bonded to the titanium which are composed of carbon, oxygen and hydrogen atoms.

In this invention the titanium is disclosed as being "derived from" certain compounds. By the term "derived from" we mean that the titanium compound chemically combines either partially or completely with other materials and consequently the titanium compound per se does not necessarily exist in the final polyetherester. For example, it is thought the titanium compound can chemically combine with the phosphorus compound.

In this invention the amount of titanium can be from 25–200 weight parts per million, preferably 50–150 weight parts per million, based on the weight of the polyetherester.

The fiber of this invention is prepared according to methods well known in the art.

According to one method of practicing this invention a polyester prepolymer is formed by contacting terephthalic acid and 1,4-cyclohexanedimethanol and poly(oxyethylene)glycol, optionally in the presence of manganous ion in the form of a salt, a titanium catalyst, and a sufficient quantity of the compound from which the phosphorus is derived to provide from 0–60 weight parts per million phosphorus, based on the weight of the polyetherester.

As will be recognized by those skilled in the art, water is eliminated during formation of the oligomeric product, or methanol is eliminated when dimethyl terephthalate is used, and there is formed a hydroxy terminated low molecular polymer having a degree of polymerization of 4 to 8.

The thermodynamic conditions used to form the ester interchange product can vary depending on the particular desires of the practitioner of the invention. Thus, one skilled in the art could select a wide variety of pressure and temperature conditions suitable to form the ester interchange product. One example of thermodynamic conditions that can be used is a pressure in the range of 14 to 50 psi and a temperature of 150° to 300° C. An example of preferred thermodynamic conditions for continuous polymerization is a pressure of 20 to 35 psi and a temperature of 180° to 280° C. Other thermodynamic conditions can be used.

The initial step in practicing the invention has been described as involving formation of "a polyetherester polymer." As will be recognized by one skilled in the art during ester interchange the terephthalic acid combines with 1,4-cyclohexanedimethanol to form monomeric structures such as

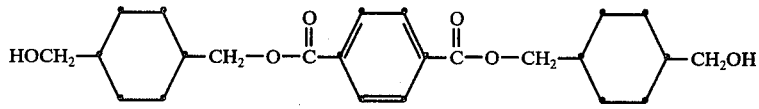

or oligomeric structures such as

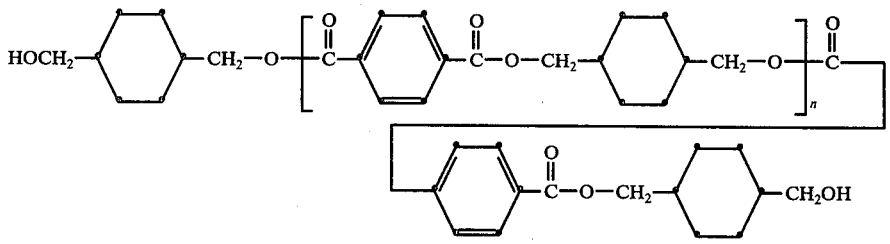

where $n$ is a small whole number. During ester interchange it is thought that the phosphorus present in the reaction mixture may also be esterified and become a part of the monomeric or oligomeric structures. If this happens, the phosphorus will be incorporated in the structure of the final polyetherester.

The poly(oxyethylene)glycol can be contacted with the other materials during formation of the polyetherester prepolymer by a variety of conventional methods. In one embodiment, the contact can be accomplished using an in-line mixer in a continuous system. In another embodiment, the contact can be accomplished by charging the poly(oxyethylene)-glycol to a batch reactor along with the other materials. Preferably the contact is accomplished by adding the poly(oxyethylene)glycol at atmospheric or higher than atmospheric pressure before ester interchange has occurred. Although the contact can be accomplished within a broad range of pressures and temperatures, in one particularly desirable embodiment the pressure can range from 15 to 35 psi and the temperature can be from 160° to 280° C.

The process for preparing the textile fiber of this invention has been described in terms of forming a polyetherester prepolymer containing the recited materials "under ester interchange conditions". Although the process of the invention has been described in this manner, the invention is not to be considered limited to forming the polyetherester prepolymer "under ester interchange conditions". For example, a polymeric type product could be formed from terephthalic acid and 1,4-cyclohexanedimethanol which could contain the manganous ion and the phosphorus, and then the poly(oxyethylene)glycol could be added to form the polyetherester prepolymer. According to another method, a polymeric type product can be formed from terephthalic acid, 1,4-cyclohexanedimethanol and the poly(oxyethylene)glycol and then the manganous ion and phosphorus can be added to form the polyetherester prepolymer. According to still another method, the above described polymeric type product can be formed containing the manganous ion and phosphorus then added to form the polyetherester prepolymer. According to still one further method, the above described polymeric type product can be formed containing the phosphorus and the manganous ion can then be added to form the polyetherester prepolymer. The polyetherester prepolymer can be formed in other ways.

The next step in practicing this invention involves forming a final polyetherester, having an inherent viscosity of at least 0.4, from the contacted ester interchange product and poly(oxyethylene)glycol. This step, often called polycondensation by those skilled in the art, can be accomplished in conventional equipment well known in the art. The thermodynamic conditions used to form the final polyetherester can vary widely depending on the desires of the practitioner of the invention. According to one manner in which the invention can be practiced, the high molecular weight polyetherester is formed at a pressure within the range of 0.1 to 10 mm. Hg. and a temperature within the range of 280° to 300° C. by the elimination of 1,4-cyclohexanedimethanol. According to a preferred manner of practicing the invention, the pressure is within a range of 0.5 to 3 mm. of Hg. Preferably the inherent viscosity of the final polyetherester is at least 0.65.

According to one method of practicing the invention, a portion of the total amount of phosphorus to be used can be added to form the polyester prepolymer and the remaining phosphorus can be added to the final polyetherester. Although the phosphorus compound can be added to the polyetherester in a variety of conventional ways, one particularly desirable method is to add the phosphorus compound to the final polyetherester as it exits from the reaction vessel using an in line mixer. Other methods can be used, such as coating pellets with the phosphorus compound, to add the phosphorus compounds to the polyetherester.

The next step in practicing the invention involves admixing with the final polyetherester, based on the weight of the polyetherester, from 1000–5000 weight parts per million of the stabilizer effective to prevent oxidative degradation of the polyetherester. The final polyetherester of high molecular weight can be admixed with the stabilizer according to techniques well known in the art, such as application from a volatile solvent onto extruded pellets, mixing the polymer with a small quantity of a second polymer containing a relatively large amount of stabilizer or, preferably, coextrusion from the polymerization reactor wherein the final polyetherester is formed.

The next step is practicing the invention involves melt spinning the admixture of the final polyetherester and stabilizer into fibers in accordance with techniques well known in the art. According to one method of practicing the invention melt spinning is conducted at a temperature of about 305° C. and a pressure of about 600 psi.

The next step in practicing this invention involves drafting the fibers according to techniques well known in the art. A draft ratio of 1:3.0–5.0 can be used. If desired, the drafting can be accomplished in two stages in water and steam in accordance with conventional technology.

According to one method of practicing this invention, a portion of the phosphorus can be incorporated into the fiber by contacting the fibers with a sufficient quantity of the compound from which the phosphorus is derived. Although a wide variety of thermodynamic conditions can be used to accomplish the sixth step, a temperature range of 80° to 120° C. is particularly desirable.

Although a wide variety of conventional methods such as wiper bars, rollers, etc., can be used to perform the contacting function, in a preferred embodiment the compound from which phosphorus is derived is introduced into a stuffer box crimper. In this embodiment, an admixture of 50 mole percent of an amine salt of a compound corresponding to the formula

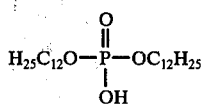

and 50 mole percent of an amine salt of a compound corresponding to the formula

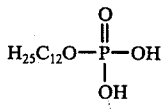

are introduced into a stuffer box crimper.

When a portion of the phosphorus compound is incorporated into the fiber by contacting the fibers with the compound from which the phosphorus is derived, the next step in practicing this invention involves heating the contacted fibers to diffuse the fiber diffusion incorporated phosphorus into the fiber. According to one method of practicing this step, the heating can be accomplished within a temperature range of 160° to 250° C. for 0.05 to 20 minutes and in another method the heating can be accomplished within a temperature range of 180° to 210° C. for 3 to 10 minutes. During the heating step the compound from which the fiber diffusion incorporated phosphorus is derived diffuses from the surface of the fiber so as to uniformly reside within the structure of the fiber.

Although the process for practicing this invention has been described in terms of first accomplishing the step of drafting the spun fibers, and then accomplishing the step of contacting the drafted fibers with the phosphorus, the invention is not to be considered limited to performing these steps in this sequence. Although preferably the drafting step is conducted before the contacting step the important consideration is that both steps are accomplished, not the order in which they are accomplished. For example, the sequence of steps could be accomplishing the step of contacting the fibers with the fiber diffusion incorporated phosphorus and then accomplishing the step of drafting. Regardless of the sequence of these steps the fiber diffusion incorporated phosphorus must be contacted with the fiber before the heating step is accomplished. Preferably the sequence of steps is the drafting step and the contacting step because this sequence is one of the most commercially attractive methods of practicing the invention.

The polyetherester of this invention has an inherent viscosity of at least 0.4, and preferably at least 0.6, measured at 25° C. using 0.5 grams of polymer per 100 ml. of a solvent composed of 60 volumes of phenol and 40 volumes of tetrachloroethane.

In order for the fiber of this invention to exhibit dyeability to true shades and commercially acceptable lightfastness the metal content from catalyst metals should not be excessively high. For example, metals from polycondensation or ester interchange catalysts such as tin, titanium, zinc, etc., should not exceed 200 ppm, based on the weight of the polyetherester, and preferably should not exceed 100 ppm.

The levels of manganous ion, polymer polycondensation incorporated phosphorus, polymer incorporated phosphorus, and/or fiber diffusion incorporated phosphorus required to produce true dye shades and acceptable lightfastness depend on the poly(oxyethylene)glycol, stabilizer, and metal content of the polymer. Higher levels of manganous ion, polymer polycondensation incorporated phosphorus, polymer incorporated phosphorus and/or fiber diffusion incorporated are required for higher catalyst levels. Therefore, it is advantageous to use the lowest level of polymerization catalyst consistent with obtaining the desired polymer inherent viscosity and an acceptable production rate. Higher levels of manganous ion, and phosphorus are also required for compositions containing higher levels of poly(oxyethylene)glycol. Higher levels of stabilizer are required for higher levels of poly(oxyethylene)glycol and manganese. Generally, it can be stated that the levels of the various additives and the composition of the polymer are interdependent and variations in polymer composition require an adjustment in the level of the various additives involved to achieve the desired properties in the fiber.

Although the invention has been described in considerable detail with particular reference to certain preferred embodiments thereof, variations and modifications can be effected within the spirit and scope of the invention.

We claim:

1. A textile fiber comprised of

A. a polyetherester of
  1. terephthalic acid, and
  2. a diol component comprised of
    a. 1,4-cyclohexanedimethanol, and
    b. from 3 to 12 weight percent, based on the weight of the polyetherester, of poly(oxyethylene)glycol having a molecular weight in the range of 300–800, B. based on the weight of the polyetherester, from 0–150 weight parts per million of manganous ion, C. based on the weight of the polyetherester, from 20–500 weight parts per million phosphorus derived from
  1. phosphorus acid,
  2. phosphoric acid,
  3. pyrophosphoric acid,
  4. polyphosphoric acid, or a compound corresponding to the formula

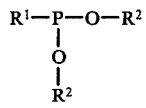

(5)

where $R^1$ is —H, a monovalent alkyl radical having 1–18 carbon atoms, a monovalent aryl or substituted aryl radical having 6–15 carbon atoms, or -O-R where R is —H, a monovalent alkyl radical having 1–18 carbon atoms or a monovalent aryl or substituted aryl radical having 6–15 carbon atoms, $R^2$ is —H, monovalent alkyl radical having 1–18 carbon atoms, or a monovalent aryl or substituted aryl radical having 6–15 carbon atoms, provided that when $R^2$ is alkyl, at least one of $R^2$ has a chain of at least two unsubstituted methylene groups attached to the oxygen atom attached to phosphorus,

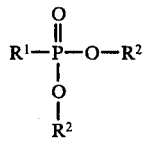

(6)

where $R^1$ and $R^2$ are the same as above,

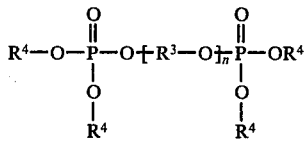

(7)

where $R^4$ is —H, a monovalent alkyl radical having 1–18 carbon atoms, or a monovalent aryl or substituted aryl radical having 6–15 carbon atoms, $n = 1–6$, $R^3 = -(CH_2)_x-$ where $x = 2–6$,

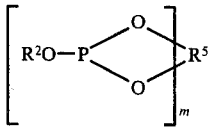

(8)

where $R^2$ is the same as above, $R^5$ is a divalent or tetravalent alkyl radical having 2–5 carbon atoms, $m$ = 1 or 2,

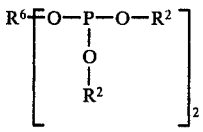

(9)

where $R^2$ is the same as above, $R^6$ is a divalent alkyl radical having 2–12 carbon atoms or a divalent aryl or substituted aryl radical having 6–15 carbon atoms,

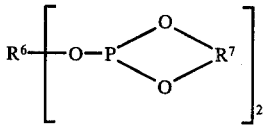

(10)

where $R^6$ is the same as above, $R^7$ is a divalent alkyl radical having 2–5 carbon atoms, D. based on the weight of the polyetherester, from 1000 to 5000 weight parts per million of a stabilizer effective to reduce oxidative degradation of the polyetherester corresponding to the structure

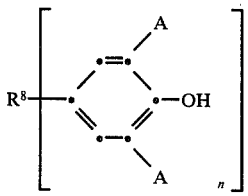

where $n$ is from 1 to 4, $R^8$ is a radical selected from the group consisting of 1. neopentanetetrayltetrakis,
2. phosphinylidynetrioxy,
3. 2,4,6-trimethyl-1,3,5-benzenetriyltrimethylene,
4. alkylene having 1 to 5 carbon atoms,
5. alkyl having 1 to 12 carbon atoms,
6. 2,4,6-trioxo-1,2,3,4,5,6-hexahydro-S-triazine1,3,5-triyl)tris(3-oxotrimethylene),
7. [3-octadecyloxy)-3-oxopropyl], A is a monovalent radical selected from the group consisting of 1. tertiary alkyl having 4 to 8 carbon atoms,
2. alkyl having 8 to 22 carbon atoms, and
3. secondary alkyl having 12 to 24 carbon atoms, E. based on the weight of the polyetherester, from 25–200 weight parts per million titanium derived from a soluble tetravalent organic titanium compound.

2. A textile fiber comprised of

A. a polyetherester of 1. terephthalic acid, and
2. a diol component comprised of
   a. 1,4-cyclohexanedimethanol, and
   b. from 8 to 12 weight percent, based on the weight of the polyetherester, of poly(oxyethylene)glycol having a molecular weight in the range of 400–600, B. based on the weight of the polyetherester, from 20–100 weight parts per million of manganous ion, C. based on the weight of the polyetherester, from 40–240 weight parts per million phosphorus derived from

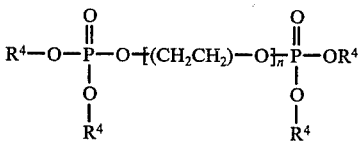

(1)

where $R^4$ is —H or a monovalent alkyl radical having 1–18 carbon atoms, $n$ = 1–6,

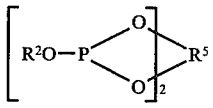

(2)

where $R^2$ is a monovalent alkyl radical having 1–18 carbon atoms, $R^5$ is a tetravalent alkyl radical having 5 carbon atoms, D. based on the weight of the polyetherester, from 1500 to 3500 weight parts per million pentaerythritol tetrakis[3-(3,5-di-tert-butyl-4-hydroxyphenyl)-propionate] having the structure

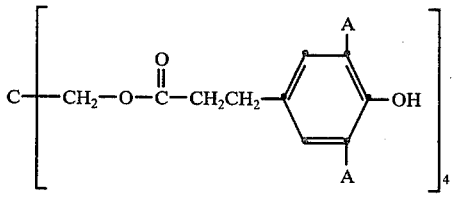

A is 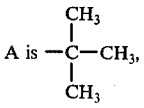 , where

E. based on the weight of the polyetherester, from 50–150 weight parts per million titanium derived from a compound corresponding to the structure

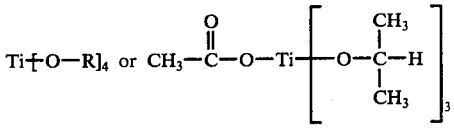

where

R is a monovalent alkyl radical having 3–18 carbon atoms.

3. A textile fiber comprised of

A. a polyetherester of 1. terephthalic acid, and
2. a diol component comprised of
   a. 1,4-cyclohexanedimethanol, and
   b. from 3 to 6 weight percent, based on the weight of the polyetherester, of poly(oxyethylene)-glycol having a molecular weight in the range of 400–600, B. based on the weight of the polyester, from 0–20 weight parts per million of manganous ion, C. based on the weight of the polyetherester, from 20–200 weight parts per million phosphorus derived from

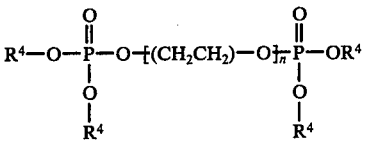

(1)

where $R^4$ is —H or a monovalent alkyl radical having 1–18 carbon atoms, $n$ = 1–6,

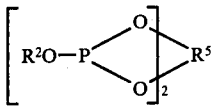

(2)

where $R^2$ is a monovalent alkyl radical having 1–18 carbon atoms, $R^5$ is a tetravalent alkyl radical having 5 carbon atoms, D. based on the weight of the polyetherester, from 1000 to 3000 weight parts per million pentaerythritol tetrakis [3-(3,5-di-tert-butyl-4-hydroxyphenyl)-propionate] having the structure

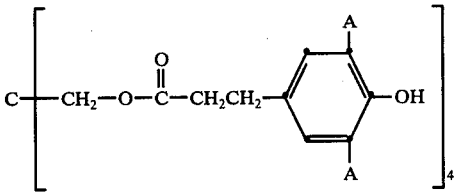

where

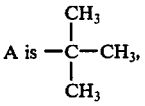

E. based on the weight of the polyetherester, from 50–150 weight parts per million titanium derived from a compound corresponding to the structure

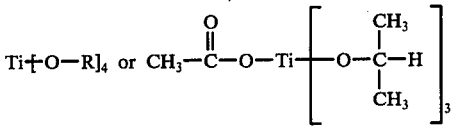

where

R is a monovalent alkyl radical having 3–8 carbon atoms.

* * * * *